United States Patent [19]

Handelman

[11] Patent Number: 4,871,209

[45] Date of Patent: Oct. 3, 1989

[54] FOLDING STADIUM SEAT

[75] Inventor: Robert I. Handelman, Chicago, Ill.

[73] Assignee: K R Industries, Inc., Chicago, Ill.

[21] Appl. No.: 200,799

[22] Filed: Jun. 1, 1988

[51] Int. Cl.[4] ..... A47C 7/02

[52] U.S. Cl. ..... 297/378; 411/510; 297/455; 297/DIG. 2

[58] Field of Search ..... 297/378, 252, 378, 453, 297/455, DIG. 2; 5/472; 411/510, 500, 509; 24/90 B, 297, 453

[56] References Cited

U.S. PATENT DOCUMENTS

| | | | |
|---|---|---|---|
| 1,912,064 | 5/1933 | Bowers | 297/378 |
| 2,466,361 | 4/1949 | Bjornskaas | 297/252 |
| 2,536,157 | 1/1951 | Campanelli | 297/378 X |
| 2,780,128 | 2/1957 | Rapta | 411/510 |
| 3,120,404 | 2/1964 | Bramming | 297/252 X |
| 3,635,521 | 1/1972 | Shivvers | 297/378 X |
| 3,736,022 | 5/1972 | Radke | 297/453 |
| 3,807,800 | 4/1974 | Morrison et al. | 297/219 X |
| 3,817,574 | 6/1974 | McNab | 297/378 X |
| 3,873,155 | 3/1975 | Barecki | 297/455 X |
| 4,214,505 | 7/1980 | Aimar | 411/510 X |

*Primary Examiner*—Peter A. Aschenbrenner
*Attorney, Agent, or Firm*—Lloyd L. Zickert

[57] ABSTRACT

A foldable stadium seat having a seat frame and backrest frame joined by a hinge assembly, made of a rigid plastic; the frames have recesses in which seat and backrest cushion pads are located. When folded, the edges of the frame meet and the pads also meet. The hinge assembly is so positioned and configured as to permit surfaces at the back portion of the seat frame and the bottom portion of the backrest frame to be used as stops to resist the thrust of a person leaning slightly backwards when the stadium seat is in use.

12 Claims, 4 Drawing Sheets

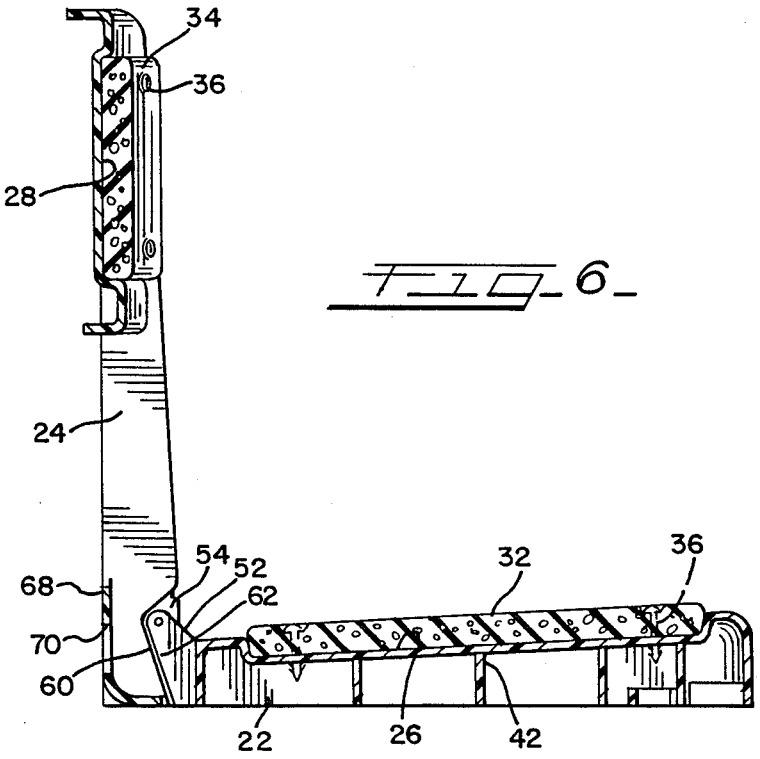
FIG. 6
FIG. 8
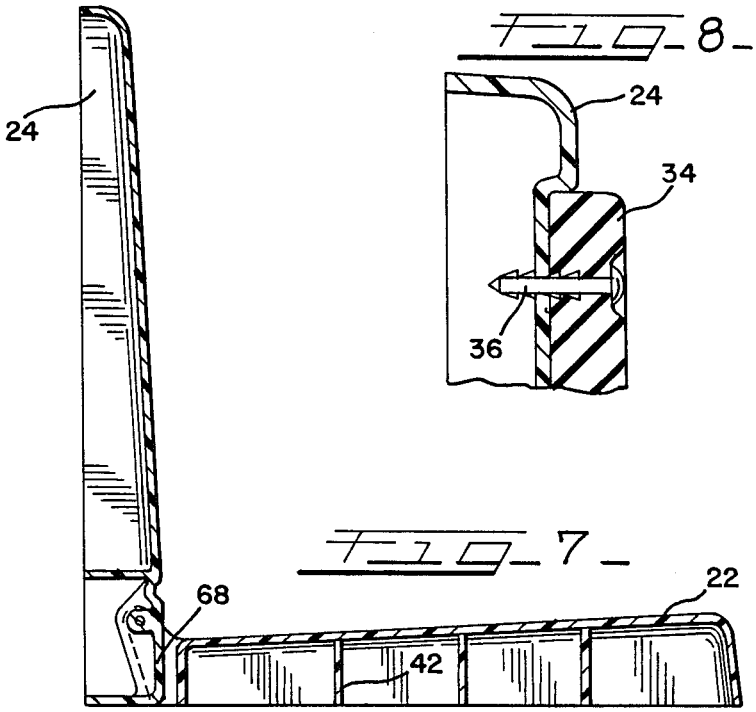
FIG. 7

FIG. 9
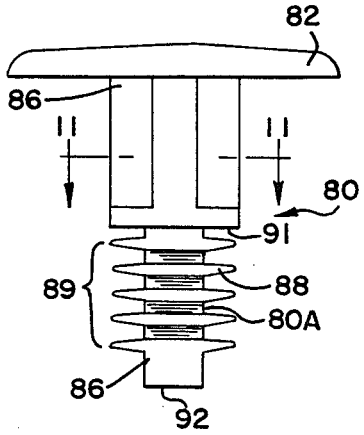
FIG. 10
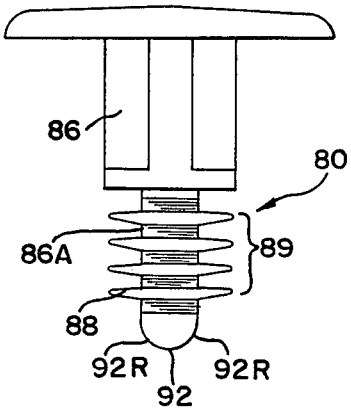
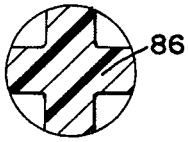
FIG. 11
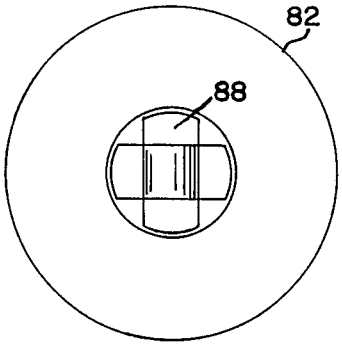
FIG. 12
FIG. 13
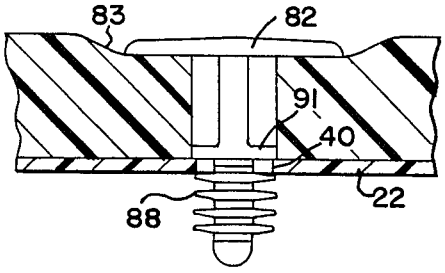

FOLDING STADIUM SEAT

BRIEF SUMMARY OF THE INVENTION

This invention relates to a folding stadium seat made principally of rigid plastic such as polypropylene, comprising a molded seat frame and a molded backrest frame hinged together. Each frame has a recess in which is disposed a soft, resilient cushion pad, and the hinge assembly is so constructed and positioned as to permit complemental surfaces at the back of the seat frame and the bottom of the backrest frame to be employed as stops, locating the backrest pad in a slightly inclined position to bear the thrust of the person leaning slightly backwards when the seat is in use. The recesses for the pads protect them against abuse and also assure a neat package when the seat is folded shut.

OBJECTIVES OF THE INVENTION

The primary object of the present invention is to construct the two frames with recesses in which the cushions or pads are disposed and secured, as a result of which the cushions are protected while enabling the seat to be neatly folded into a more compact unit than heretofore. A related object is to construct a sturdy, dependable hinge assembly by which the two frames are joined and which, at the same time, permits opposed, complemental surfaces at the back of the seat frame and the bottom of the backrest frame to serve as stops for the purpose mentioned above.

Related objects of the present invention are to so construct the backrest frame that a handstrap portion may be utilized at the bottom thereof, which projects outwardly when the seat is folded; to utilize barbed fasteners to secure the pads or cushions in place; and to allow for venting of the backrest frame.

DESCRIPTION OF THE DRAWING

FIG. 6 is a sectional view on the line 6—6 of FIG. 1;

FIG. 7 a sectional view on the line 7—7 of FIG. 1;

FIG. 8 is an enlarged, fragmentary sectional view on the line 8—8 of FIG. 1;

FIGS. 9 and 10 are side elevations, 90° apart, of a preferred fastener;

FIG. 11 is a section on the line 11—11 of FIG. 9;

FIG. 12 is a bottom plan view of the fastener shown in FIGS. 9 and 10; and FIG. 13 is a view of the fastener in place.

DETAILED DESCRIPTION

Figure 2:
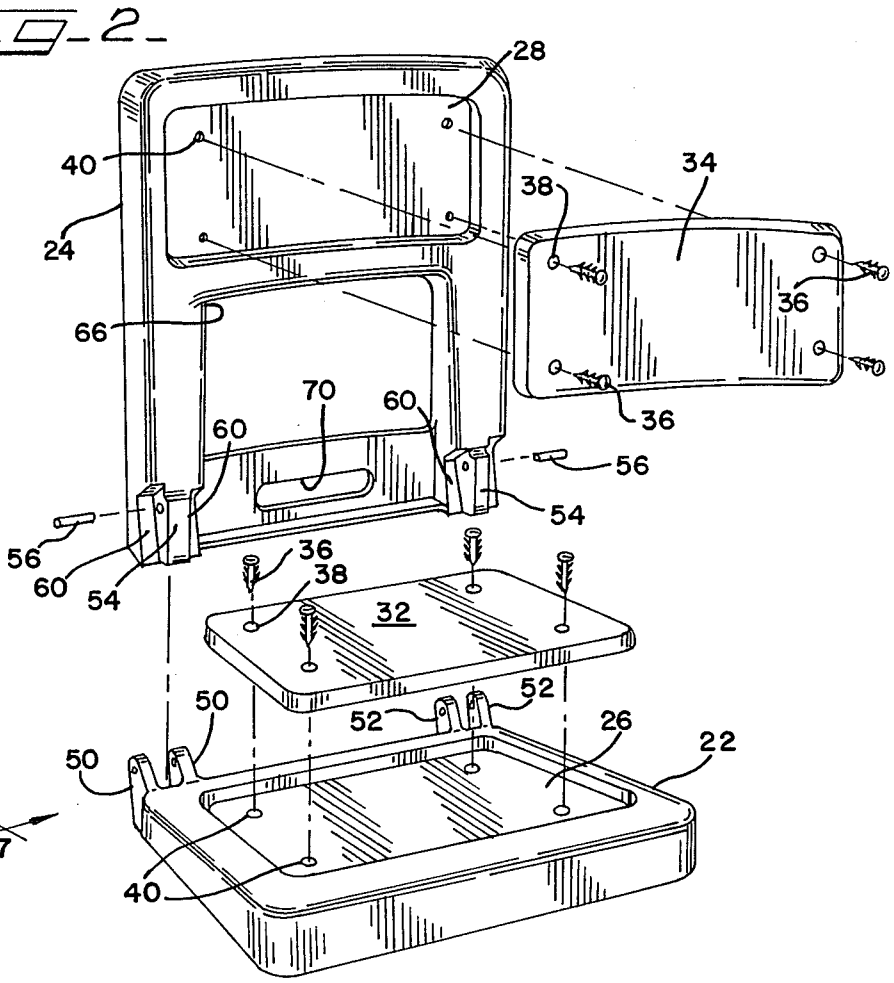
FIG. 2 is an exploded perspective view showing the frames and pads separated.
Figure 1:
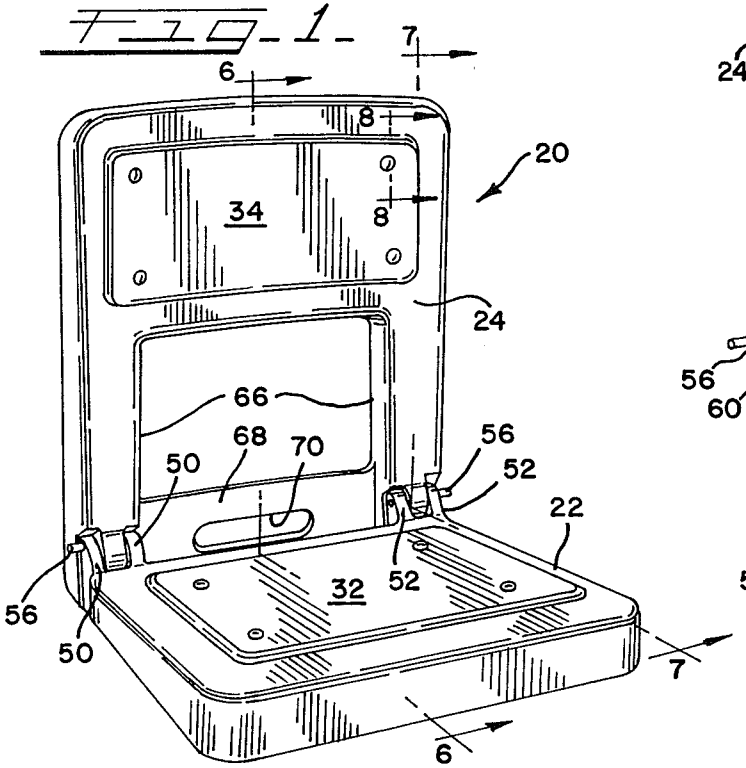
FIG. 1 is a perspective view showing the stadium seat of the present invention in the erected or open, unfolded position.
Figure 3:
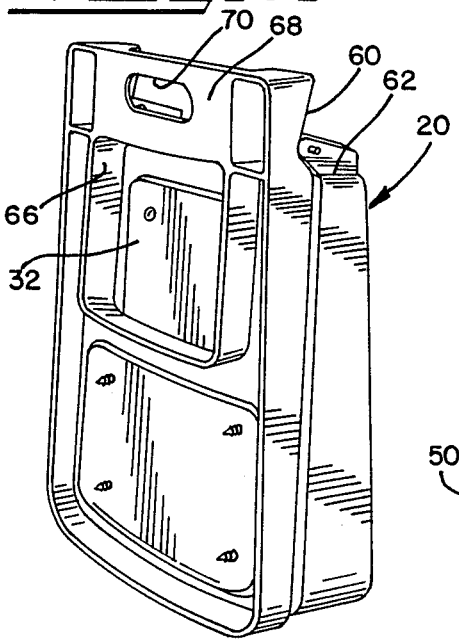
FIG. 3 is a perspective view showing the seat in its folded or closed position.

The foldable stadium seat of the present invention is shown in its open or unfolded position, ready for use, in FIG. 1 and, in FIG. 3, is shown folded or closed in a neat, compact state easily carried in the hand. As can be readily seen from FIGS. 1, 2 and 6, the backrest frame is slightly curved comfortably to fit the person's back.

More specifically, the stadium seat, FIGS. 1 and 2, comprises a molded seat frame 22 and a molded backrest frame 24, preferably of a sturdy, rigid plastic such as polypropylene.

Both the seat frame and backrest frame have rectangular recesses 26 and 28, respectively, FIG. 2. Soft, resilient pads or cushions 32 and 34 are respectively assigned to the recesses 26 and 28, these pads being of foam plastic, for example, but of course other cushion-like materials may be employed. Other sturdy, rigid plastics may also be employed for the molded frames.

The pads 32 and 34, as noted, are respectively assigned to their recesses and are secured therein by barbed or so-called "Christmas tree" fasteners 36, FIG. 2. The fasteners are positioned in respective openings 38 formed in the pads and are pressed home into opposed openings 40 in the two frames. In this manner, each pad, quite soft and spongy, is nonetheless securely mounted and the edges for the most part are guarded against fraying and tearing.

Figure 5:
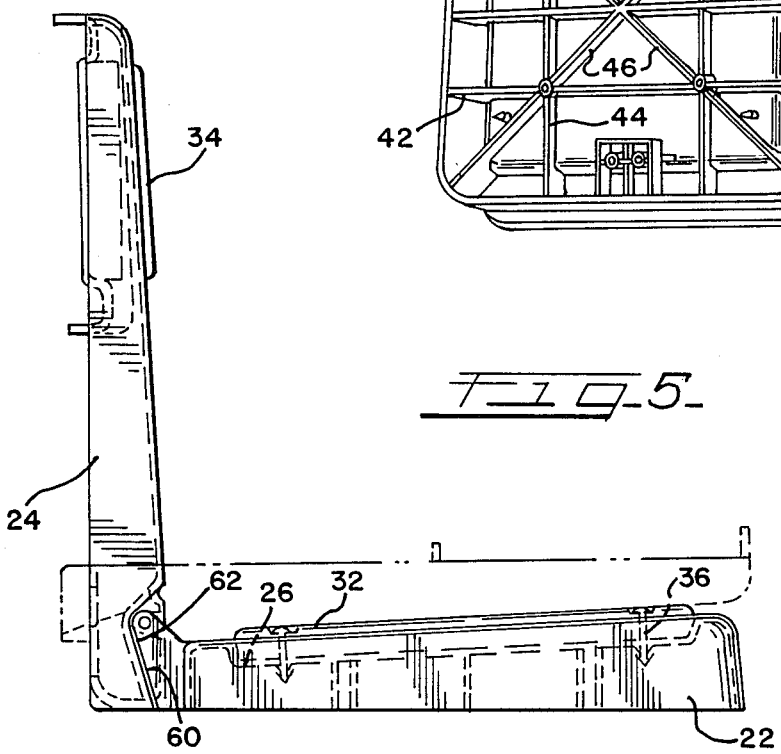
FIG. 5 is an elevation view of the seat in its open or unfolded state.

Referring to FIGS. 5 and 6, the recess 26 in the seat frame is inclined slightly downwardly in a rearwardly proceeding direction to afford comfort for the person sitting on the pad 32. In this same connection, the backrest frame, FIGS. 6 and 7, is tilted slightly rearwardly to permit a slight rearward leaning posture of the seated person.

As will also be evident in FIGS. 6 and 7, both frames are essentially of a shell or dished configuration when viewed, respectively, from the bottom and the back, which is to say that when viewed from the underside and backside, both frames are dished out. Nonetheless, the seat frame is reinforced by integral runners or cross-webs 42 and 44 as well as a pair of diagonal struts 46, FIG. 4. Resultantly, there is no question about the seat frame being able to accept the weight of a hefty occupant.

Figure 4:
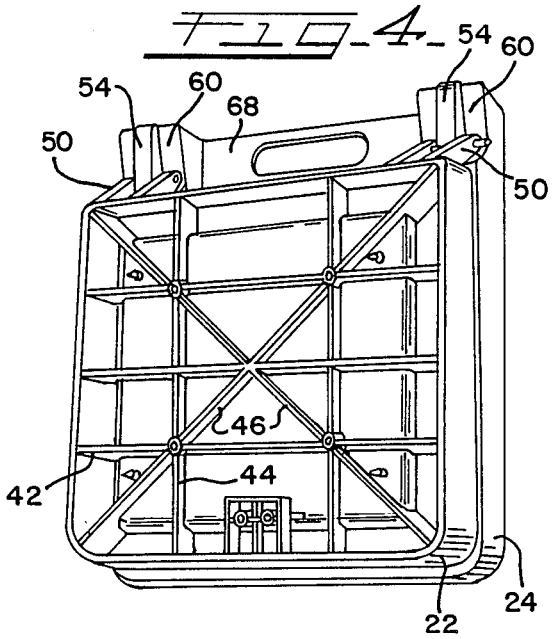
FIG. 4 is a perspective view taken at the back of the folded seat, showing details of the hinge structure and the handgrip.

The two frames are joined by a hinge assembly, respectively presented by interlocking hinge parts at the rear of the seat frame and the bottom of the backrest frame. By thus connecting the frames in a hinged fashion, they may be folded inwardly as best shown in FIGS. 3 and 4. The two frames are essentially of the same exterior, rectangular profile; hence their outer edges meet in the folded condition, FIGS. 3 and 4, and it will also be appreciated that the two pads meet one another. As a result of their resiliency and positioning in their respective recesses 26 and 28, the two pads when meeting in the folded state of the stadium chair yield and compact one another, permitting a neat folded assembly, FIGS. 3 and 4. Any type of snap fastener or friction fastener may be used to hold the folded state, if desired.

Specifically the hinge structure is defined by two pairs of spaced ears 50 and 52, FIG. 2, integrally molded at the rear corners of the seat frame. At each corner of the bottom portion of the backrest frame, two hinge lugs 54 are integrally molded as part of the backrest, and these lugs are positioned to fit in the spaces between the hinge ears 50 and 52. The hinge assembly is completed by hinge pins 56, when nesting the lugs 54 with respect to the hinge ears and inserting the pins 56 through aligned openings, as can be readily visualized from FIG. 2 without further explanation.

To locate the backrest in a slightly rearwardly and upwardly inclined position, complemental stop surfaces are afforded at the rear surface of the seat frame and the forward face at the bottom of the backrest frame. Thus, as best shown in FIGS. 2 and 5, there is ample surface area 60 on opposite sides of the two hinge lugs 54, easily opposed in a complementary sense to corresponding surfaces 62, FIG. 6, on opposite sides of the hinge ears. These bearing surfaces are sloped downwardly and forwardly, as will be readily perceived in FIG. 6, and hence when they are engaged in bearing contact the backrest frame is slightly inclined. The opposed, generous bearing surfaces in contact resist the thrust of the leaning occupant.

For further comfort, a large vent opening 66 is formed in the backrest frame in the area immediately beneath the backrest pad 34, FIGS. 1 and 2.

To facilitate carrying of the foldable stadium seat when collapsed or closed, FIG. 3, a reinforcing strap 68, integrally molded, FIG. 2, extends across the bottom portion of the backrest frame. A handle grip opening 70 is provided therein. When the backrest or upper frame is folded downwardly to meet the seat or lower frame, FIG. 5, the strap portion 68 is in effect extended beyond the hinge or joint assembly and consequently the handle grip opening 70 is in a freely available position.

It will be seen from the foregoing that by using recesses in the seat frame and backrest frame, soft but somewhat fragile pads or cushions are disposed therein with their perimeter sides safeguarded against tearing or fraying. Use of soft pads allows the seat to be easily folded since the soft pads are compacted. Generous bearing surfaces 60 and 62 assure a sturdy stop to bear the thrust of a person leaning backwards and these bearing surfaces may be viewed as the surfaces which result from the configuration of the hinge element.

A preferred fastener is shown in FIGS. 9–13, one which is sturdy, which in place assures the seat or cushion pad is compressed over a generous area (reducing chances of tear) and one which at the same time has a flat head sunken in the pad which helps to assure the head of the fastener will not be snagged or snapped off, especially in cold weather.

The preferred fastener 80, FIGS. 9 and 10, is of a sturdy molded plastic, having a large head 82, substantially flat on the upper and lower faces so that when the fastener is pressed home, FIG. 13, it compresses the seat cushion over a large generous area (tending to prevent tearing of the cushion pad) and at the same time the head is sunk in the soft cushion material resulting in an indentation or concavity 83 which assures the head is unlikely to be snapped off, especially in cold weather, or snagged.

The fastener has an integral shank 86 dependent from the head. The shank is cruciform in cross section, FIG. 11. The lower end of the shank is sectioned (or reduced in diameter at axially spaced positions 86A) so that there are a plurality of axially spaced segments, specifically thin cruciform fins 88 (see FIG. 12) axially spaced from one another along the length of the lower end portion 89 of the shank. These fins or barbs are thin enough to be somewhat flexible. They are slightly larger in diameter than the opening 40 in the seat frame 22 through which they are to be pressed, FIG. 13, but when so pressed through the tips of the blades or barbs 88 flex upwardly and inwardly a little to allow passage. Then, when the fastener is all the way home, FIG. 13, the lower end portion 89 has entirely passed through the seat frame opening and the fins unflex or extend to their original attitude blocking or covering the opening 40 through which they were forced, preventing displacement of the fastener.

The portion of the shank immediately above the uppermost set of fins constitutes a stop 91, FIGS. 9 and 13. The stop, like the fins 88, is of slightly larger diameter than the seat frame opening 40. The stop defines the home position of the fastener whereat the fins 88 have unflexed or expanded and whereat the head has been sunk in the cushion pad.

The tip 92 of the lower end portion of the shank is beveled or rounded at 92R, FIG. 10, at least on opposed sides of the tip, to guide the shank into the opening 40.

It will be appreciated that any suitable clamping or mounting means may be secured to the bottom of the seat frame to facilitate use of the seat on a suitable support.

It will be understood that modifications and variations may be effected without departing from the scope of the novel concepts of the present invention, but it is understood that this application is to be limited only by the scope of the appended claims.

I claim:

1. A foldable, portable stadium seat of molded, rigid plastic comprising a seat from having a front and rear portion, and a backrest frame which, in the erected or open position, includes a lower portion and an upper portion, the two frames being joined by a hinge assembly at the rear portion of the seat frame and at the lower portion of the backrest frame, said seat frame having a recess therein and the upper portion of said back frame also having a recess therein, a soft resilient cushion pad located in each recess for comfortable cushioning the person using the stadium seat in the open or unfolded position, and means permanently fastening said resilient cushion pads in the recesses of said frames including openings in the pads matching openings in the frame recesses and fasteners extending through the opening to secure the pads to the frames, each fastener having a head adapted to indent the pad and form a concave recess therein such that the head is surrounded by the cushion, and a shank extending through said cushion and frame openings, said shank including a shoulder spaced from the head and sized larger than said frame opening to space the head from the frame a predetermined distance and function as a stop when assembling the fastener with the pad and frame, and radially extending fins flexibly extending from the shank beyond the shoulder and sized larger than the frame opening such that when forcibly driven through the frame opening the fins expand and lock the fastener to the frame.

2. A stadium seat according to claim 1 in which the seat recess is inclined slightly rearwardly and downwardly and in which the backrest recess is inclined slightly rearwardly and upwardly to accommodate a slight rearward leaning or reclining position for the person using the stadium seat in the open position.

3. A stadium seat according to claim 1 in which the two frames have opposed engagable stop surfaces respectively at the rear of the seat frame and the lower portion of the backrest frame affording apple bearing surfaces to support the thrust of the person when leaning backwards.

4. A seat according to claim 2 in which the two frames have opposed engagable stop surfaces respectively at the rear of the seat portion frame and the lower portion of the backrest frame affording ample bearing surfaces to support the thrust of the person leaning backwards.

5. A seat according to claim 3 in which the hinge assembly includes pairs of spaced ears at the rear corners of the seat frame and mating lugs at the lower portion corners of the backrest frame disposed in the spaces between said ears, and in which the stop surfaces include forwardly and downwardly inclined surfaces on opposite sides of the hinge lugs and complementary surfaces at the back of the seat frame adjacent the hinge ears.

6. A seat according to claim 5 in which the backrest frame has an integrally molded strap portion between the hinge lugs in which a handgrip is formed.

7. A flexible, portable stadium seat according to claim 1 in which the side edges of the two frames as well as the two pads meet when the seat is folded, and in which the backrest frame at the lower portion thereof has an integrally molded strap portion between the hinge lugs and formed with a handgrip.

8. A stadium seat according to claim 1 in which the backrest frame, at the lower portion and between the hinge assembly and the backrest pad, is provided with an open vent.

9. A portable foldable seat comprising a seating portion and a backrest portion, said portions being molded of a substantially rigid plastic and hinged at adjacent edges, each portion having respectively seating and backrest surfaces and including a recessed area, a cushion pad matingly received in each area and projecting slightly above said surfaces, means fastening said pads to said portions, said portions in the recessed areas including openings and the cushion pad having matching openings into which a plurality of said fastening means are entered to secure the cushion pads in the recessed areas, each of said fastening means having a head with substantially flat upper and lower faces, a shank integral with and dependent from said head and having a lower portion with a plurality of axially spaced fins thereon, a stop on the shank intermediate said head and the uppermost of the fins, said stop being slightly larger than the opening in said seating portion to allow passage of only the lower end portion of the shank through the opening in said seating portion, and said fins being slightly larger than the opening in said seating portion but flexing upon entry into and passage through said opening in the seating position, the fins unflexing or expanding radially outwardly after passing the opening thereby to cover the opening and prevent displacement of the fastener, whereby the head, stop and fins are spaced axially so that when passage of the fastener into the opening in the seat portion is stopped, the flat head indents and forms a concave recess in the cushion pad whereby the head is sunken in the cushion pad material, hinge means at the hinged edges, means coacting with the hinge means to stop the backrest portion in a predetermined position with respect to the seating portion, and integrally formed handle means on one of said portions to facilitate carrying the seat in folded relation.

10. A seat according to claim 9 in which the shank is cruciform in cross section including said lower portion thereof, and in which the fins are thin outwardly projecting segments sectioned from the lower end portion of said shank.

11. A seat according to claim 10 in which the stop is the cruciform portion of the shank immediately above the uppermost fins.

12. A seat according to claim 11 wherein the tip of the lower end portion of the shank is beveled or rounded to guide the shank into the opening in the seat frame portion.

* * * * *